US011247883B2

(12) United States Patent
Hill et al.

(10) Patent No.: US 11,247,883 B2
(45) Date of Patent: Feb. 15, 2022

(54) SHOE TYING SUPPORT ASSEMBLY

(71) Applicants: Joseph Hill, Orlando, FL (US); Annie Hill, Orlando, FL (US)

(72) Inventors: Joseph Hill, Orlando, FL (US); Annie Hill, Orlando, FL (US)

( * ) Notice: Subject to any disclaimer, the term of this patent is extended or adjusted under 35 U.S.C. 154(b) by 370 days.

(21) Appl. No.: 16/454,401

(22) Filed: Jun. 27, 2019

(65) Prior Publication Data

US 2020/0407203 A1 Dec. 31, 2020

(51) Int. Cl.

| | |
|---|---|
| ***B66F 7/06*** | (2006.01) |
| ***B66F 3/22*** | (2006.01) |
| ***B66F 3/08*** | (2006.01) |
| *A47C 16/02* | (2006.01) |
| *B66F 7/08* | (2006.01) |

(52) U.S. Cl.

CPC ..... *B66F 3/22* (2013.01); *B66F 3/08* (2013.01); *B66F 7/065* (2013.01); *A47C 16/025* (2013.01); *B66F 7/08* (2013.01)

(58) Field of Classification Search

CPC ..... A47C 16/025; B66F 7/065; B66F 3/22; B66F 7/08; B66F 3/08; B66F 7/0625; B66F 7/22; A61G 7/005; A47G 25/84

USPC ..... D6/349; 297/423.46, 423.45; D3/200; 254/122, 126, 124, 7 R; 5/610; 108/8; 414/642

See application file for complete search history.

(56) References Cited

U.S. PATENT DOCUMENTS

| | | | | |
|---|---|---|---|---|
| 2,637,449 | A * | 5/1953 | Hamer | B66F 13/00 414/642 |
| 3,653,715 | A | 4/1972 | Drabert | |
| D262,667 | S | 1/1982 | Thompson | |
| 5,400,720 | A * | 3/1995 | Stevens | A47B 9/16 108/147 |
| D371,462 | S | 7/1996 | Grossmith | |
| 5,577,806 | A | 11/1996 | Ugalde | |
| 6,145,931 | A | 11/2000 | Subotic | |
| 6,474,666 | B1 | 11/2002 | Andersen | |
| 8,616,652 | B1 | 12/2013 | Wells | |
| 8,911,021 | B1 | 12/2014 | Styke | |
| 2001/0020304 | A1* | 9/2001 | Roit | A61G 7/012 5/611 |
| 2008/0086820 | A1* | 4/2008 | Brenner | A47C 16/025 5/648 |
| 2009/0102267 | A1 | 4/2009 | Larocque | |
| 2015/0328068 | A1* | 11/2015 | Hruschka | A61G 7/012 5/610 |

* cited by examiner

*Primary Examiner* — Mahdi H Nejad

(57) ABSTRACT

A shoe tying support assembly includes a frame that is positionable on a floor. A scissor lift is movably coupled to the frame and the scissor lift is actuatable between a lifted position and a lowered position. A platform is positioned on the scissor lift and the platform is spaced upwardly from the frame when the scissor lift is actuated into the lifted position. Thus, a user can position their foot on the platform for assisting with tying shoes. A tilting unit is coupled between the scissor lift and the platform and the tilting unit tilts the platform at a selectable angle of deflection from a horizontal plane to enhance comfort for the user to position the user's foot on the platform. A remote control is provided to remotely control the scissor lift and the tilting unit.

10 Claims, 6 Drawing Sheets

SHOE TYING SUPPORT ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to support devices and more particularly pertains to a new support device for elevating a user's foot for tying shoes.

BRIEF SUMMARY OF THE INVENTION

An embodiment of the disclosure meets the needs presented above by generally comprising a frame that is positionable on a floor. A scissor lift is movably coupled to the frame and the scissor lift is actuatable between a lifted position and a lowered position. A platform is positioned on the scissor lift and the platform is spaced upwardly from the frame when the scissor lift is actuated into the lifted position. Thus, a user can position their foot on the platform for assisting with tying shoes. A tilting unit is coupled between the scissor lift and the platform and the tilting unit tilts the platform at a selectable angle of deflection from a horizontal plane to enhance comfort for the user to position the user's foot on the platform. A remote control is provided to remotely control the scissor lift and the tilting unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
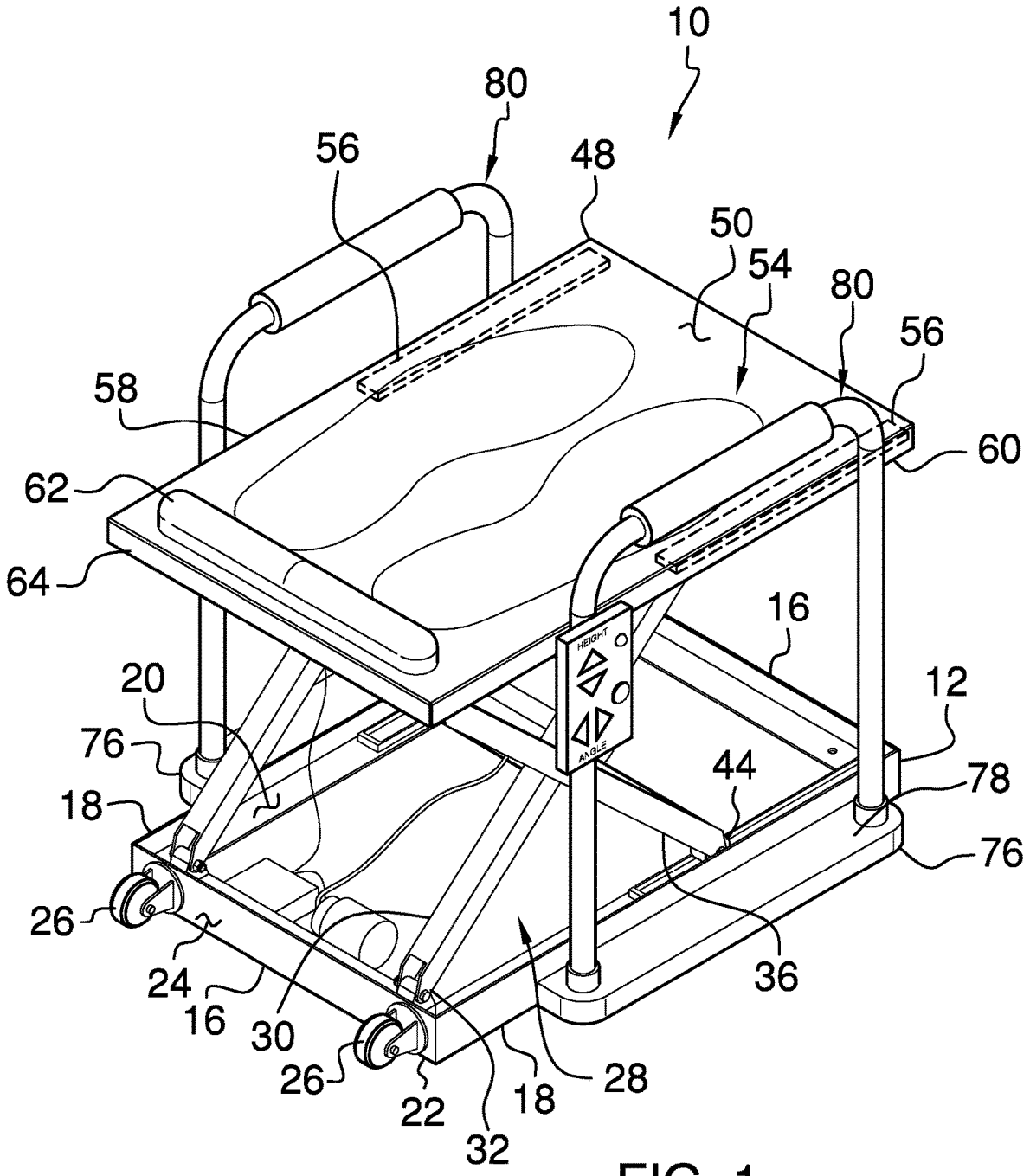
FIG. 1 is a top perspective view of a shoe tying support assembly according to an embodiment of the disclosure.
Figure 2:
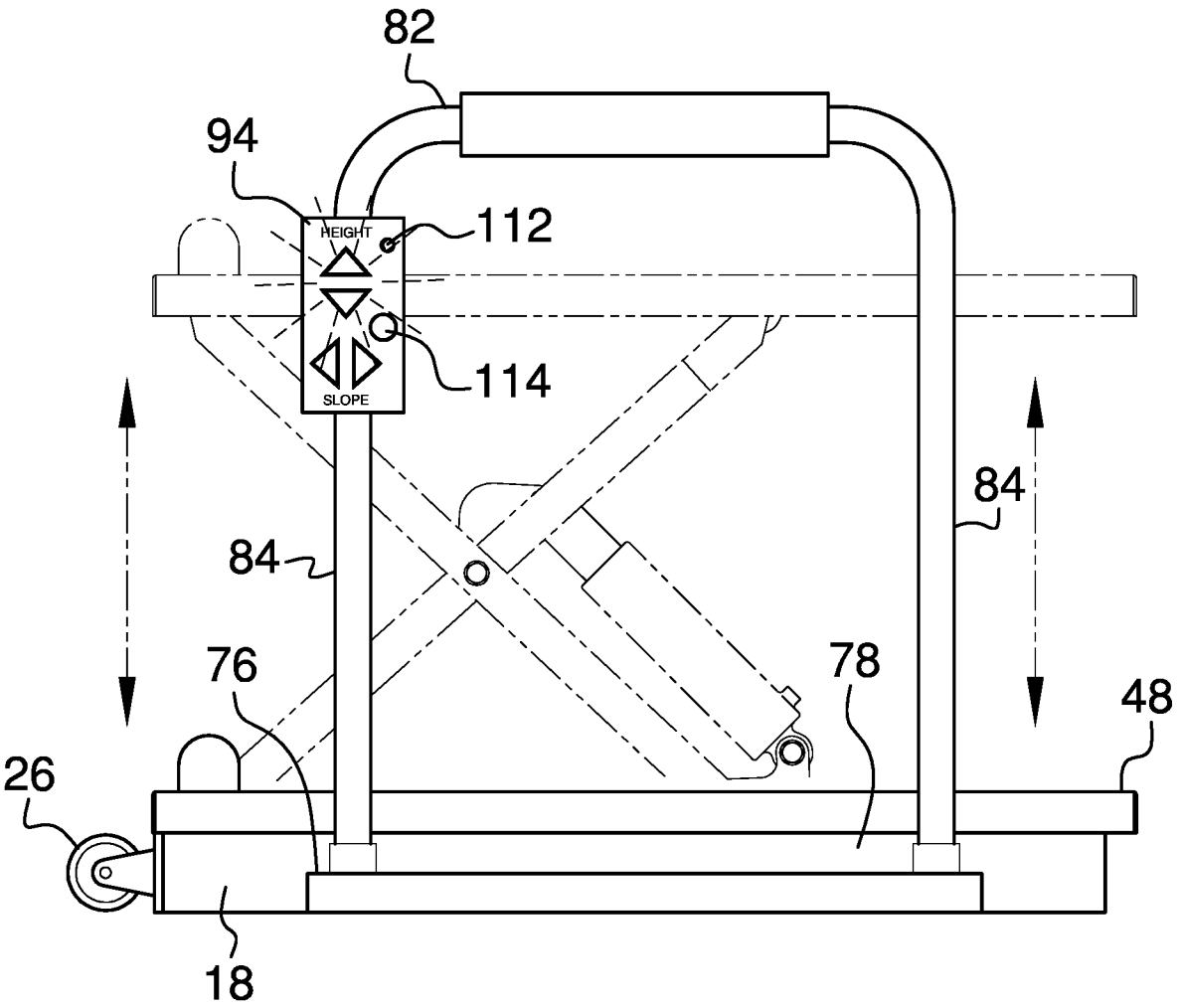
FIG. 2 is a right side view of an embodiment of the disclosure.
Figure 3:
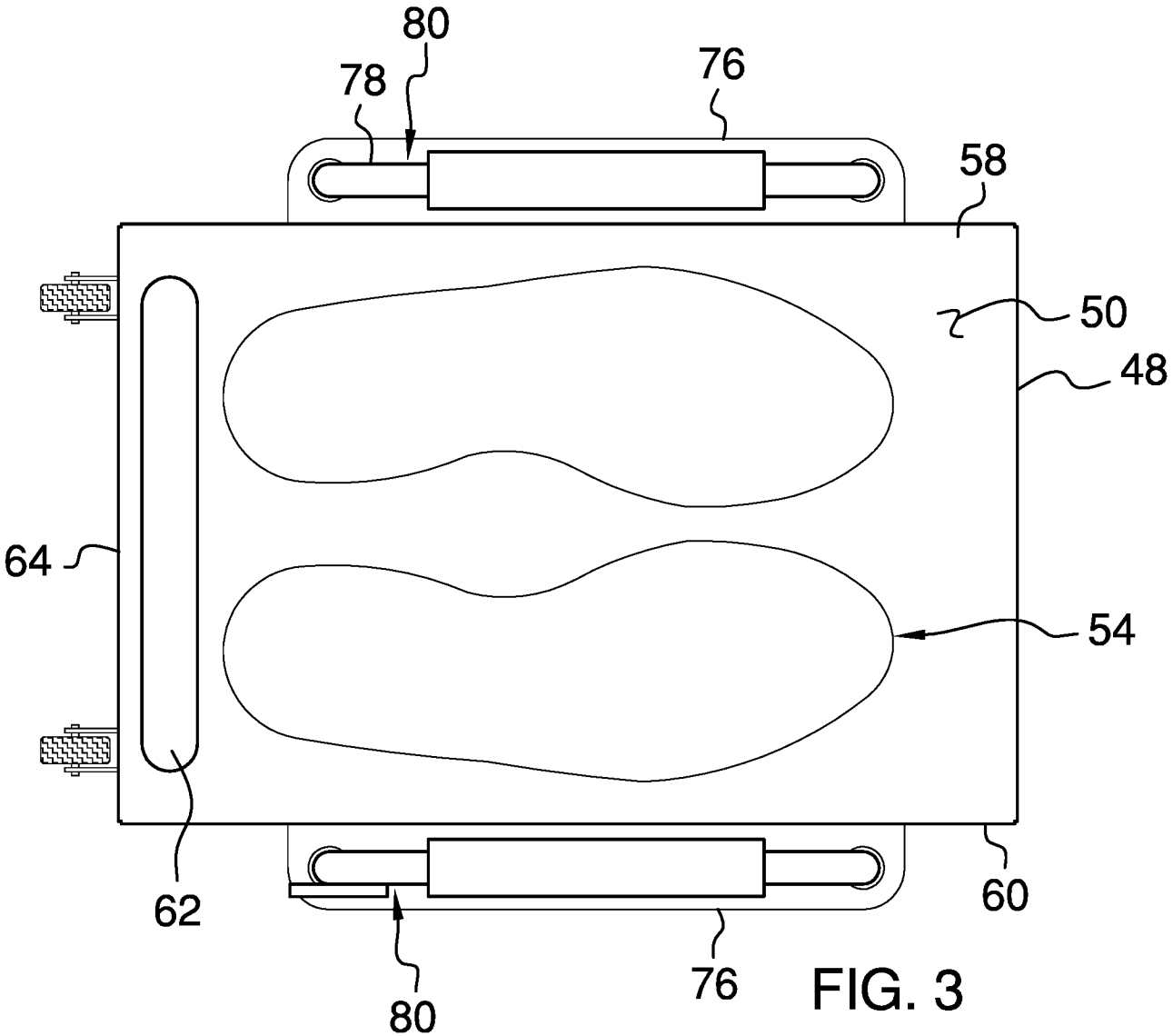
FIG. 3 is a top view of an embodiment of the disclosure.
Figure 4:
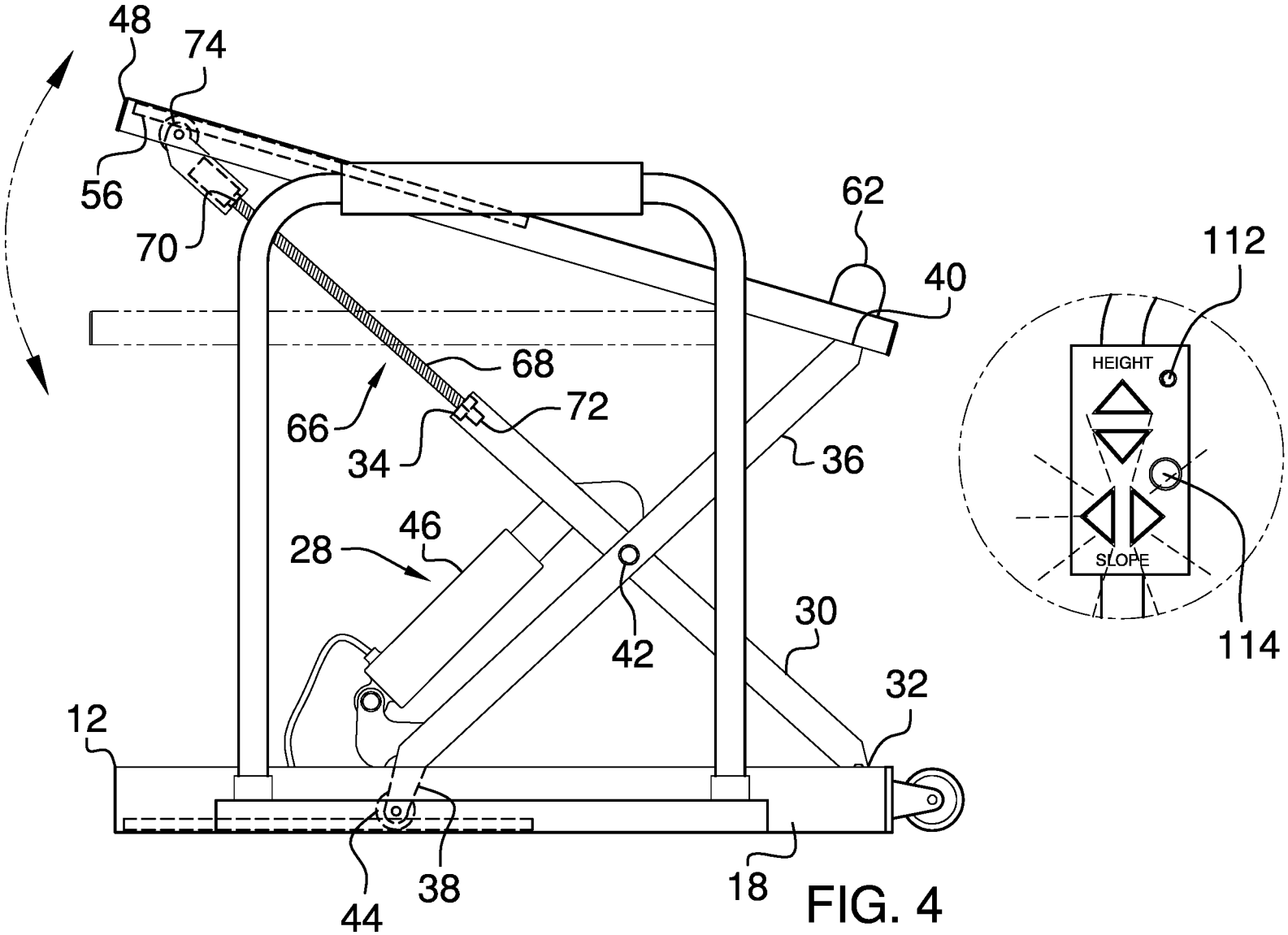
FIG. 4 is a left side view of an embodiment of the disclosure.
Figure 5:
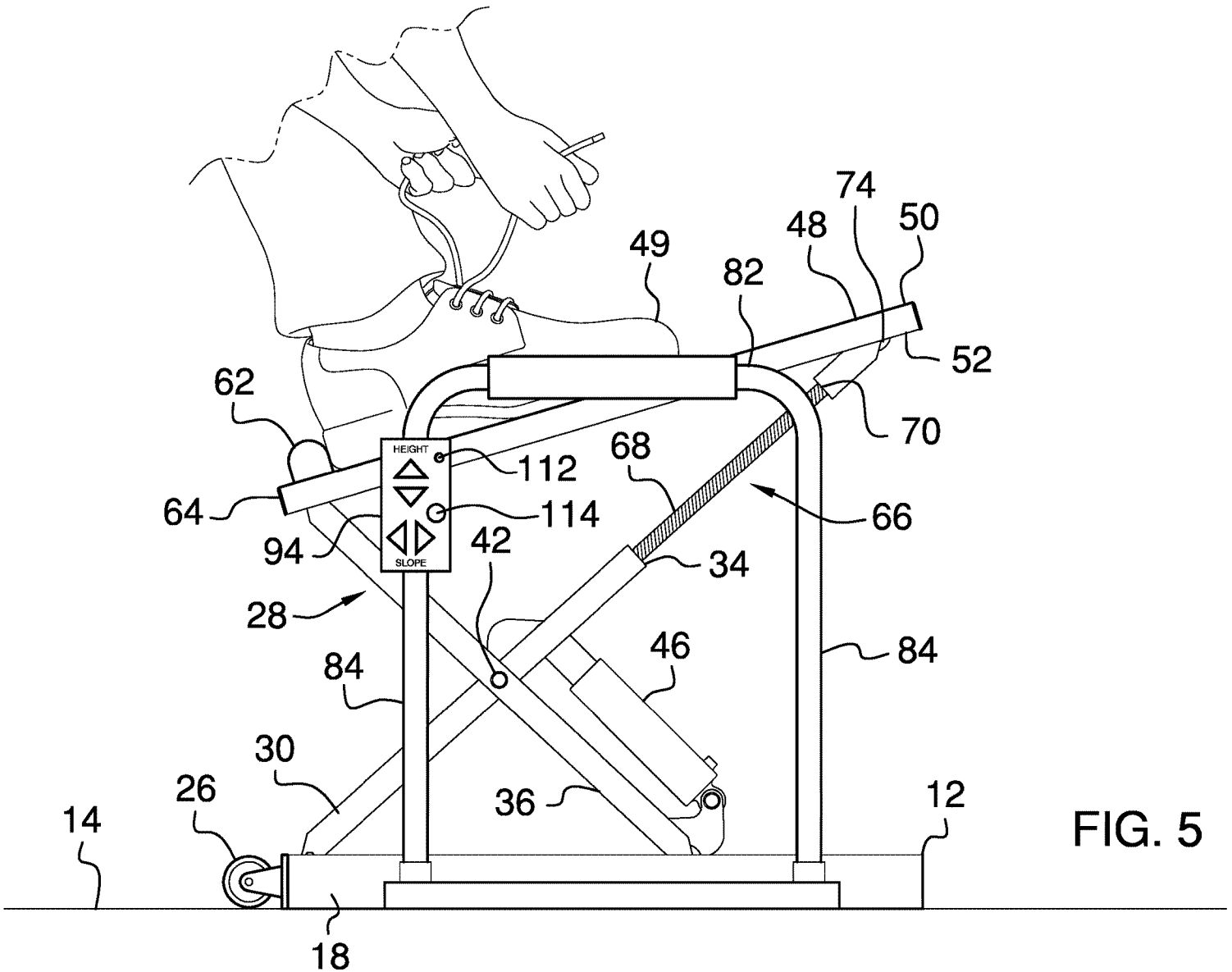
FIG. 5 is a perspective in-use view of an embodiment of the disclosure.
Figure 6:
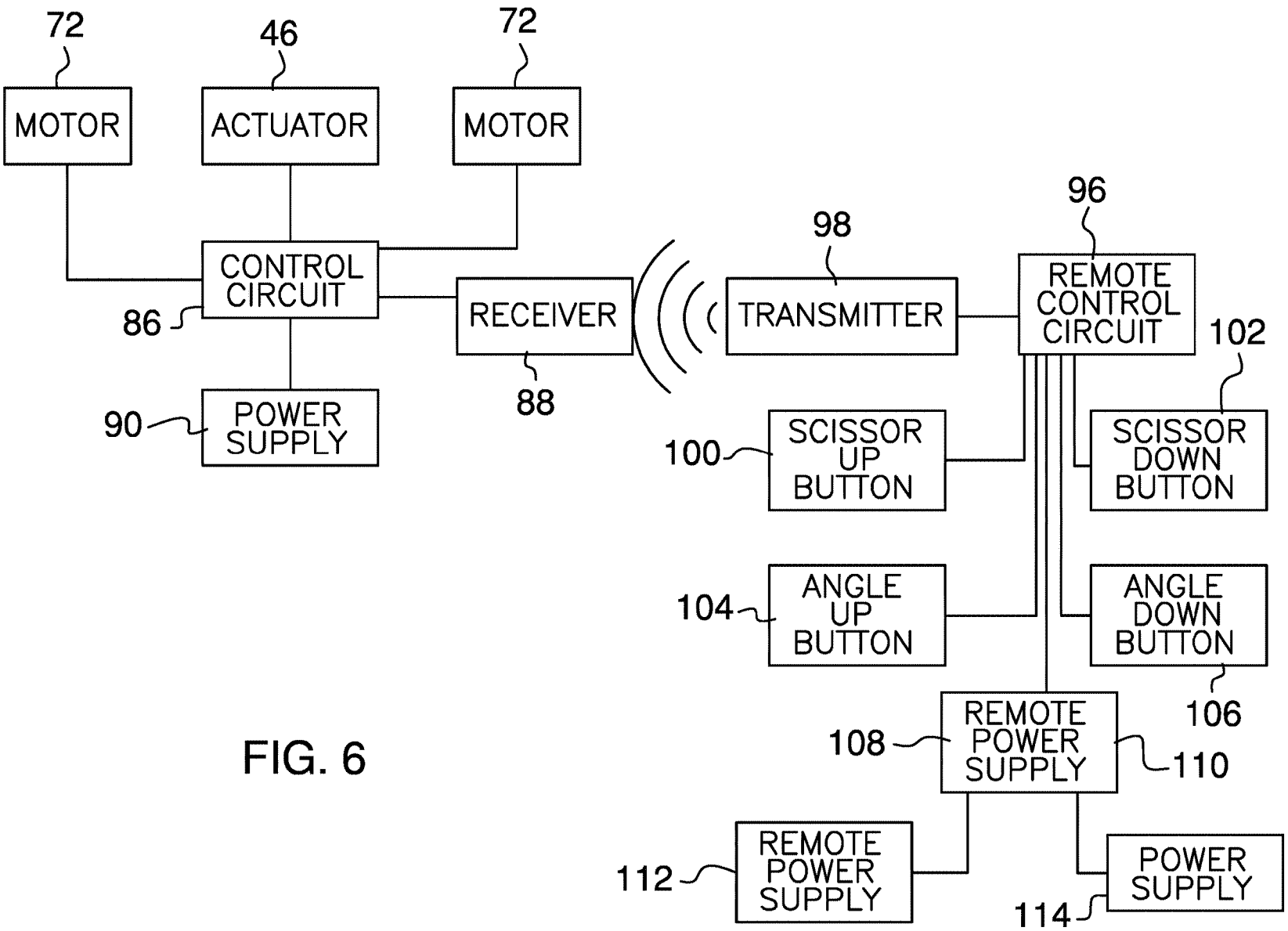
FIG. 6 is a schematic view of an embodiment of the disclosure.

With reference now to the drawings, and in particular to FIGS. 1 through 6 thereof, a new support device embodying the principles and concepts of an embodiment of the disclosure and generally designated by the reference numeral 10 will be described.

As best illustrated in FIGS. 1 through 6, the shoe tying support assembly 10 generally comprises a frame 12 that is positionable on a floor 14 or other horizontal support surface. The frame 12 includes a pair of first members 16 that each extends between a pair of second members 18. The second members 18 are spaced apart from each other such that the frame 12 defines a rectangle. Each of the first 16 and second 18 members has a top surface 20, a bottom surface 22 and an outwardly facing surface 24, and the bottom surface 22 of each of the first 16 and second 18 members rests on the floor 14 when the frame 12 is positioned on the floor 14. A pair of rollers 26 is each coupled to the outwardly facing surface 24 of a respective one of the first members 16 of the frame 12. In this way each the rollers 26 can roll along the floor 14 when the frame 12 is tipped onto the respective first member 16.

A scissor lift 28 is movably coupled to the frame 12 and the scissor lift 28 is actuatable between a lifted position and a lowered position. The scissor lift 28 comprises a pair of first arms 30 that each has a first end 32 and a second end 34. The first end 32 of each of the first arms 30 is hingedly coupled to the top surface 20 of a respective one of the first members 16 of the frame 12 and the second end 34 of each of the first arms 30 is open. The second end 34 of each of the first arms 30 is spaced upwardly from the frame 12 when the scissor lift 28 is actuated into the lifted position. Conversely, the second end 34 of each of the first arms 30 is positioned adjacent to the frame 12 when the scissor lift 28 is actuated into the lowered position.

The scissor lift 28 includes a pair of second arms 36 that each has a primary end 38 and a secondary end 40. Each of the second arms 36 is pivotally coupled to a respective one of the first arms 30 at a pivot point 42 that is centrally positioned relative to each of the first 34 and second 36 arms. The secondary end 40 of each of the second arms 36 is spaced upwardly from the frame 12 when the scissor lift 28 is actuated into the lifted position. Conversely, the secondary end 40 of each of the second arms 36 is positioned adjacent to the frame 12 when the scissor lift 28 is actuated into the lowered position.

A pair of second arm rollers 44 is each coupled to the primary end 38 of a respective one of the second arms 36. Each of the second arm rollers 44 rollably engages the top surface 20 of a respective one of the second members 18 of the frame 12. Each of the second arm rollers 44 travels toward a respective one of the first members 16 of the frame 12 when the scissor lift 28 is actuated into the lowered position. Each of the second arm rollers 44 travels toward a center of the second members 18 of the frame 12 when the scissor lift 28 is actuated into the lifted position.

An actuator 46 is coupled between the frame 12 and the pivot point 42. The actuator 46 lengthens when the actuator 46 is actuated to lift thereby spacing the pivot point 42 upwardly from the frame 12. Conversely, the actuator 46 shortens when the actuator 46 is actuated to lower thereby positioning the pivot point 42 adjacent to the frame 12. The actuator 46 may be a hydraulic piston, an electromechanical linear actuator or any other type of actuator that can lengthen and shorten. A fluid reservoir and a hydraulic pump may be provided for supplying hydraulic pressure to the hydraulic piston when the hydraulic piston is employed as the actuator 46.

A platform 48 is provided and the platform 48 is positioned on the scissor lift 28. The platform 48 is spaced upwardly from the frame 12 when the scissor lift 28 is actuated into the lifted position. Thus, a user can position a foot 49 on the platform 48 for assisting with tying shoes or any other activity that involved the user's feet 49. The platform 48 is positioned adjacent to the frame 12 when the scissor lift 28 is actuated into the lowered position.

The platform 48 has a top surface 50 and a bottom surface 52, and the top surface 50 has indicia 54 printed thereon. The indicia 54 comprise an image of a pair of footprints for indicating where the user should place their feet 50. A pair of tracks 56 is each coupled to the bottom surface 22 of the platform 48 and each of the tracks 56 is aligned with a respective first 58 and second 60 lateral edge of the platform 48. A stop 62 is coupled to and extends upwardly from the top surface 20 of the platform 48. The stop 62 is oriented collinear with a rear edge 64 of the platform 48 to inhibit the user's foot 50 from sliding rearwardly off of the platform 48.

A tilting unit 66 is coupled between the scissor lift 28 and the platform 48. The tilting unit 66 tilts the platform 48 at a selectable angle of deflection from a horizontal plane. In this way the tilting unit 66 can enhance comfort for the user for positioning the user's foot 50 on the platform 48 with minimal ankle bending. The tilting unit 66 comprises a pair of screws 68 that is each inserted into the second end 34 of a respective one of the first arms 30 of the scissor lift 28. Each of the screws 68 has a distal end 70 with respect to the respective first arm 30. A pair of motors 72 is each coupled to a respective one of the screws 68 and each of the motors 72 rotates in a first direction or a second direction when the motors 72 are turned on. Each of the screws 68 is rotated to screw outwardly from the respective first arm 30 when the motors 72 rotate in the first direction. Each of the screws 68 is rotated to screw inwardly on the respective first arm 30 when the motors 72 rotate in the second direction.

A pair of tilt rollers 74 is each coupled to the distal end of a respective one of the screws 68. Each of the tilt rollers 74 rollably engages a respective one of the tracks 56 on the platform 48 for tilting the platform 48 when the motors 72 rotate the screws 68. A pair of shelves 76 is each of the shelves 76 is coupled to and extends laterally away from the outwardly facing surface 24 of a respective one of the second members 18 of the frame 12. Each of the shelves 76 has a top side 78.

A pair of handles 80 is each coupled to and extends upwardly from the frame 12. Each of the handles 80 is positioned on opposite sides of the platform 48 and each of the handles 80 comprises a central member 82 extending between a pair of uprights 84. Each of the uprights 84 is coupled to and extends upwardly from the top side 78 of a respective one of the shelves 76. Moreover, the central member 82 of each of the handles 80 is spaced upwardly from the top surface 50 of the platform 48.

A control circuit 86 is coupled to the frame 12 and the control circuit 86 has each of the motors 72 and the actuator 46 being electrically coupled thereto. A receiver 88 is coupled to the frame 12 and the receiver 88 is electrically coupled to the control circuit 86. The receiver 88 may comprise a radio frequency receiver 88 or the like. A power supply 90 is coupled to the frame 12, the power supply 90 is electrically coupled to the control circuit 86 and the power supply 90 comprises at least one rechargeable battery.

A remote control 94 is provided and the remote control 94 is in wireless communication with the scissor lift 66 and the tilting unit 66. The remote control 94 actuates the scissor lift 66 to a selected point between the lifted position and the lowered position. In this way the platform 48 can be positioned at a comfortable elevation for the user. Additionally, the remote control 94 actuates the tilting unit 66 to tilt the platform 48 to the selected angle of deflection.

The remote control 94 includes a remote control circuit 96 is positioned within the remote control 94 and a transmitter 98 that is positioned within the remote control 94. The transmitter 98 is electrically coupled to the remote control circuit 96 and the transmitter 98 is in wireless communication with the receiver 88. In this way the remote control circuit 96 is in communication with the control circuit 86 on the frame 12. A scissor up button 100 is movably coupled to the remote control 94, the scissor up button 100 is electrically coupled to the remote control 94 and the scissor lift 66 is actuated to lift the platform 48 when the scissor up button 100 is depressed. A scissor down button 102 is movably coupled to the remote control 94, the scissor down button 102 is electrically coupled to the remote control circuit 96 and the scissor lift 66 is actuated to lower the platform 48 when the scissor down button 102 is depressed.

An angle up button 104 is movably coupled to the remote control 94, the angle up button 104 is electrically coupled to the remote control circuit 96 and each of the motors 72 is turned on to screw the screws 68 inwardly for moving the platform 48 toward the horizontal plane. An angle down button 106 is movably coupled to the remote control 94, the angle down button 106 is electrically coupled to the remote control circuit 96 and each of the motors 72 is turned on to screw the screws 68 outwardly for moving the platform 48 away from the horizontal plane. A remote power supply 108 is positioned within the remote control 94, the remote power supply 108 is electrically coupled to the remote control circuit 96 and the remote power supply 108 comprises at least one battery 110.

A low battery indicator 112 is coupled to the remote control 94 and the lower battery indicator 112 illuminates when the remote power supply 108 falls below a predetermined charge. The low battery indicator 112 may comprise an LED or the like. Additionally, a power button 114 is movably coupled to the remote control 94 and the power button 114 is electrically coupled to the remote control circuit 96. The power button 114 turns the remote control circuit 96 on and off.

In use, the frame 12 is positioned in an area where the user might be tying their shoes or performing other activities on their feet. The remote control 94 is manipulated to lift the platform 48 to a selected height and to tilt the platform 48 to a selected angle. In this way the platform 48 can be oriented at an optimal position to facilitate the user to position the user's feet on the platform 48. Moreover, the platform 48 facilitates the user to touch the user's feet with a minimum amount of bending over. In this way the platform 48 assists a physically limited user, such as an elderly person or a person with a lower back injury, to tie shoes or perform other activities on the feet. Additionally, the scissor lift 66 and the tilting unit 66 facilitate the platform 48 to be positioned at a variety of heights and angles, thereby accommodating a variety of users.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A shoe tying support assembly being configured to have a physically limited user's foot placed thereon when the physically limited user is putting on and tying shoes, said assembly comprising:

a frame being positionable on a floor;

a scissor lift being movably coupled to said frame, said scissor lift being actuatable between a lifted position and a lowered position;

a platform being positioned on said scissor lift, said platform being spaced upwardly from said frame when said scissor lift is actuated into said lifted position wherein said platform is configured to have a user's foot positioned thereon for assisting with said tying shoes, said platform being positioned adjacent to said frame when said scissor lift is actuated into said lowered position;

a tilting unit being coupled between said scissor lift and said platform, said tilting unit tilting said platform at a selectable angle of deflection from a horizontal plane wherein said tilting unit is configured to enhance comfort for the user to position the user's foot on said platform;

a pair of handles, each of said handles being coupled to and extending upwardly from said frame, each of said handles being positioned on opposite sides of said platform;

a control circuit being coupled to said frame, said control circuit having each of a pair of motors and an actuator for the scissor lift being electrically coupled thereto; and a remote control being in wireless communication with said scissor lift and said tilting unit, said remote control actuating said scissor lift to a selected point between said lifted position and said lowered position wherein said platform is configured to be positioned at a comfortable elevation for the user, said remote control actuating said tilting unit to tilt said platform to the selected angle of deflection;

wherein said frame includes a pair of first members each extending between a pair of second members, said second members being spaced apart from each other such that said frame defines a rectangle, each of said first and second members having a top surface, a bottom surface and an outwardly facing surface, said bottom surface of each of said first and second members resting on the floor when said frame is positioned on the floor; and wherein said scissor lift comprises a pair of first arms, each of said first arms having a first end and a second end, said first end of each of said arms being hingedly coupled to said top surface of a respective one of said first members of said frame, said second end of each of said first arms being open, said second end of each of said first arms being spaced upwardly from said frame when said scissor lift is actuated into said lifted position, said second end of each of said first arms being positioned adjacent to said frame when said scissor lift is actuated into said lowered position; and wherein said tilting unit comprises:

a pair of screws, each of said screws being inserted into said second end of a respective one of said first arms of said scissor lift, each of said screws having a distal end with respect to said respective first arm; and the pair of motors, each of said motors being coupled to a respective one of said screws, each of said motors rotating in a first direction or a second direction when said motors are turned on, each of said screws screwing outwardly from said respective first arm when said motors rotate in said first direction, each of said screws screwing inwardly on said respective first arm when said motors rotate in said second direction.

2. The assembly according to claim 1, wherein said scissor lift comprises a pair of second arms, each of said second arms having a primary end and a secondary end, each of said second arms being pivotally coupled to a respective one of said first arms at a pivot point being centrally positioned relative to each of said first and second arms, said secondary end of each of said second arms being spaced upwardly from said frame when said scissor lift is actuated into said lifted position, said secondary end of each of said second arms being positioned adjacent to said frame when said scissor lift is actuated into said lowered position.

3. The assembly according to claim 2, wherein said scissor lift includes a pair of second arm rollers, each of said second arm rollers being coupled to said primary end of a respective one of said second arms, each of said second arm rollers rollably engaging said top surface of a respective one of said second members of said frame, each of said second arm rollers travelling toward a respective one of said first members of said frame when said scissor lift is actuated into said lowered position, each of said second arm rollers travelling toward a center of said second members of said frame when said scissor lift is actuated into said lifted position.

4. The assembly according to claim 2, wherein said scissor lift includes the actuator being coupled between said frame and said pivot point, said actuator lengthening when said actuator is actuated to lift thereby spacing said pivot point upwardly from said frame, said actuator shortening when said actuator is actuated to lower thereby positioning said pivot point adjacent to said frame.

5. The assembly according to claim 1, wherein:

said assembly includes a pair of tracks, each of said tracks being coupled to said bottom surface of said platform, each of said tracks being aligned with a respective first and second lateral edge of said platform; and said tilting unit includes a pair of tilt rollers, each of said tilt rollers being coupled to said distal end of a respective one of said screws, each of said tilt rollers rollably engaging a respective one of said tracks on said platform for tilting said platform when said motors rotate said screws.

6. The assembly according to claim 1, wherein:

said assembly includes a pair of shelves, each of said shelves being coupled to and extending laterally away from said outwardly facing surface of a respective one of said second members of said frame, each of said shelves having a top side; and each of said handles comprises a central member extending between a pair of uprights, each of said uprights being coupled to and extending upwardly from said top side of a respective one of said shelves, said central member of each of said handles being spaced upwardly from said top surface of said platform.

7. The assembly according to claim 1, further comprising:

a receiver being coupled to said frame, said receiver being electrically coupled to said control circuit; and a power supply being coupled to said frame, said power supply being electrically coupled to said control circuit, said power supply comprising at least one rechargeable battery.

8. The assembly according to claim 7, wherein said remote control comprises:

a remote control circuit being positioned within said remote control; and a transmitter being positioned within said remote control, said transmitter being electrically coupled to said remote control circuit, said transmitter being in wireless communication with said receiver such that said remote control circuit is in communication with said control circuit on said frame.

9. The assembly according to claim 8, wherein said remote control comprises:

a scissor up button being movably coupled to said remote control, said scissor up button being electrically coupled to said remote control, said scissor lift being actuated to lift said platform when said scissor up button is depressed;

a scissor down button being movably coupled to said remote control, said scissor down button being electrically coupled to said remote control circuit, said scissor lift being actuated to lower said platform when said scissor down button is depressed;

an angle up button being movably coupled to said remote control, said angle up button being electrically coupled to said remote control circuit, each of said motors being turned on to screw said screws inwardly for moving said platform toward said horizontal plane; and an angle down button being movably coupled to said remote control, said angle down button being electrically coupled to said remote control circuit, each of said motors being turned on to screw said screws outwardly for moving said platform away from said horizontal plane.

10. A shoe tying support assembly being configured to have a physically limited user's foot placed thereon when the physically limited user is putting on and tying shoes, said assembly comprising:

a frame being positionable on a floor, said frame including a pair of first members each extending between a pair of second members, said second members being spaced apart from each other such that said frame defines a rectangle, each of said first and second members having a top surface, a bottom surface and an outwardly facing surface, said bottom surface of each of said first and second members resting on the floor when said frame is positioned on the floor;

a pair of rollers, each of said rollers being coupled to said outwardly facing surface of a respective one of said first members of said frame wherein each of said rollers is configured to roll along the floor when said frame is tipped onto said respective first member;

a scissor lift being movably coupled to said frame, said scissor lift being actuatable between a lifted position and a lowered position, said scissor lift comprising:

a pair of first arms, each of said first arms having a first end and a second end, said first end of each of said arms being hingedly coupled to said top surface of a respective one of said first members of said frame, said second end of each of said first arms being open, said second end of each of said first arms being spaced upwardly from said frame when said scissor lift is actuated into said lifted position, said second end of each of said first arms being positioned adjacent to said frame when said scissor lift is actuated into said lowered position;

a pair of second arms, each of said second arms having a primary end and a secondary end, each of said second arms being pivotally coupled to a respective one of said first arms at a pivot point being centrally positioned relative to each of said first and second arms, said secondary end of each of said second arms being spaced upwardly from said frame when said scissor lift is actuated into said lifted position, said secondary end of each of said second arms being positioned adjacent to said frame when said scissor lift is actuated into said lowered position;

a pair of second arm rollers, each of said second arm rollers being coupled to said primary end of a respective one of said second arms, each of said second arm rollers rollably engaging said top surface of a respective one of said second members of said frame, each of said second arm rollers travelling toward a respective one of said first members of said frame when said scissor lift is actuated into said lowered position, each of said second arm rollers travelling toward a center of said second members of said frame when said scissor lift is actuated into said lifted position; and an actuator being coupled between said frame and said pivot point, said actuator lengthening when said actuator is actuated to lift thereby spacing said pivot point upwardly from said frame, said actuator shortening when said actuator is actuated to lower thereby positioning said pivot point adjacent to said frame;

a platform being positioned on said scissor lift, said platform being spaced upwardly from said frame when said scissor lift is actuated into said lifted position wherein said platform is configured to have a user's foot positioned thereon for assisting with said tying shoes, said platform being positioned adjacent to said frame when said scissor lift is actuated into said lowered position, said platform having a top surface and a bottom surface, said top surface having indicia being printed thereon, said indicia comprising an image of a pair of footprints for indicating where the user should place their feet;

a pair of tracks, each of said tracks being coupled to said bottom surface of said platform, each of said tracks being aligned with a respective first and second lateral edge of said platform;

a stop being coupled to and extending upwardly from said top surface of said platform, said stop being oriented collinear with a rear edge of said platform wherein said stop is configured to inhibit the user's foot from sliding rearwardly off of said platform;

a tilting unit being coupled between said scissor lift and said platform, said tilting unit tilting said platform at a selectable angle of deflection from a horizontal plane wherein said tilting unit is configured to enhance comfort for the user to position the user's foot on said platform, said tilting unit comprising:

a pair of screws, each of said screws being inserted into said second end of a respective one of said first arms of said scissor lift, each of said screws having a distal end with respect to said respective first arm;

a pair of motors, each of said motors being coupled to a respective one of said screws, each of said motors rotating in a first direction or a second direction when said motors are turned on, each of said screws screwing outwardly from said respective first arm when said motors rotate in said first direction, each of said screws screwing inwardly on said respective first arm when said motors rotate in said second direction; and a pair of tilt rollers, each of said tilt rollers being coupled to said distal end of a respective one of said screws, each of said tilt rollers rollably engaging a respective one of said tracks on said platform for tilting said platform when said motors rotate said screws;

a pair of shelves, each of said shelves being coupled to and extending laterally away from said outwardly facing surface of a respective one of said second members of said frame, each of said shelves having a top side;

a pair of handles, each of said handles being coupled to and extending upwardly from said frame, each of said handles being positioned on opposite sides of said platform, each of said handles comprising a central member extending between a pair of uprights, each of said uprights being coupled to and extending upwardly from said top side of a respective one of said shelves, said central member of each of said handles being spaced upwardly from said top surface of said platform;

a control circuit being coupled to said frame, said control circuit having each of said motors and said actuator being electrically coupled thereto;

a receiver being coupled to said frame, said receiver being electrically coupled to said control circuit;

a power supply being coupled to said frame, said power supply being electrically coupled to said control circuit, said power supply comprising at least one rechargeable battery; and a remote control being in wireless communication with said scissor lift and said tilting unit, said remote control actuating said scissor lift to a selected point between said lifted position and said lowered position wherein said platform is configured to be positioned at a comfortable elevation for the user, said remote control actuating said tilting unit to tilt said platform to the selected angle of deflection, said remote control comprising:

a remote control circuit being positioned within said remote control;

a transmitter being positioned within said remote control, said transmitter being electrically coupled to said remote control circuit, said transmitter being in wireless communication with said receiver such that said remote control circuit is in communication with said control circuit on said frame;

a scissor up button being movably coupled to said remote control, said scissor up button being electrically coupled to said remote control, said scissor lift being actuated to lift said platform when said scissor up button is depressed;

a scissor down button being movably coupled to said remote control, said scissor down button being electrically coupled to said remote control circuit, said scissor lift being actuated to lower said platform when said scissor down button is depressed;

an angle up button being movably coupled to said remote control, said angle up button being electrically coupled to said remote control circuit, each of said motors being turned on to screw said screws inwardly for moving said platform toward said horizontal plane;

an angle down button being movably coupled to said remote control, said angle down button being electrically coupled to said remote control circuit, each of said motors being turned on to screw said screws outwardly for moving said platform away from said horizontal plane; and a remote power supply being positioned within said remote control, said remote power supply being electrically coupled to said remote control circuit, said remote power supply comprising at least one battery.

* * * * *